US008735033B2

(12) United States Patent
Wang et al.

(10) Patent No.: US 8,735,033 B2
(45) Date of Patent: May 27, 2014

(54) TONER PROCESS USING ACOUSTIC MIXER

(75) Inventors: Yulin Wang, Oakville (CA); Kimberly Nosella, Mississauga (CA); David Kurceba, Hamilton (CA); Santiago Faucher, Oakville (CA)

(73) Assignee: Xerox Corporation, Norwalk, CT (US)

( * ) Notice: Subject to any disclaimer, the term of this patent is extended or adjusted under 35 U.S.C. 154(b) by 14 days.

(21) Appl. No.: 13/434,565

(22) Filed: Mar. 29, 2012

(65) Prior Publication Data

US 2013/0260310 A1 Oct. 3, 2013

(51) Int. Cl.
*G03G 9/093* (2006.01)

(52) U.S. Cl.
USPC ..... 430/107.1; 430/137.1; 430/137.11

(58) Field of Classification Search
CPC .... G03G 9/0804; G03G 9/081; G03G 9/0819
USPC ..... 430/137.1–137.21
See application file for complete search history.

(56) References Cited

U.S. PATENT DOCUMENTS 5,290,654 A 3/1994 Sacripante
5,302,486 A 4/1994 Patel
5,346,797 A 9/1994 Kmiecik-Lawrynowicz
5,364,729 A 11/1994 Kmiecik-Lawrynowicz
5,403,693 A 4/1995 Patel
5,418,108 A 5/1995 Kmiecik-Lawrynowicz
5,501,935 A 3/1996 Patel
5,527,658 A 6/1996 Hopper
5,585,215 A 12/1996 Ong
5,650,255 A 7/1997 Ng
5,650,256 A 7/1997 Veregin
5,853,943 A 12/1998 Cheng
6,063,827 A 5/2000 Sacripante
6,593,049 B1 7/2003 Veregin
6,756,176 B2 6/2004 Stegamat
6,830,860 B2 12/2004 Sacripante
2006/0222991 A1 10/2006 Sacripante
2007/0072105 A1* 3/2007 Fromm et al. ..... 430/109.2
2010/0266949 A1* 10/2010 Lai et al. ..... 430/137.14
2010/0310983 A1* 12/2010 Ou et al. ..... 430/137.14
2012/0082926 A1* 4/2012 Suzuki et al. ..... 430/105
2013/0164664 A1* 6/2013 Kamel et al. ..... 430/105

* cited by examiner

*Primary Examiner* — Mark F Huff
*Assistant Examiner* — Rashid Alam
(74) *Attorney, Agent, or Firm* — Pillsbury Winthrop Shaw Pittman LLP

(57) ABSTRACT

A process for making emulsion aggregation (EA) toners is provided. In embodiments, the process comprises aggregating a mixture comprising a latex resin, and at least one colorant in a reactor to form aggregated toner particles, adding a shell resin to form a shell over the aggregated toner particles, coalescing the aggregated toner particles, and recovering the toner particles.

20 Claims, 6 Drawing Sheets

TONER PROCESS USING ACOUSTIC MIXER

BACKGROUND

The presently disclosed embodiments relate generally to a process for producing emulsion aggregation (EA) toners suitable for electrostatographic apparatuses.

Numerous processes are within the purview of those skilled in the art for the preparation of EA toners. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

EA toner processes include coagulating a combination of emulsions, i.e., emulsions each including, independent of one another or meaning that they can be the same or different, a latex, wax, pigment, and the like, with a flocculent such as polyaluminum chloride and/or aluminum sulfate, to generate a slurry of primary aggregates which then undergoes a controlled aggregation process. The solid content of this primary slurry dictates the overall throughput of the EA toner process. While an even higher solids content may be desirable, it may be difficult to achieve due to high viscosity of the emulsions and poor mixing, which may lead to the formation of unacceptable primary aggregates (high coarse particle content).

Current EA toner processes require the addition of flocculent while homogenizing with an IKA homogenizer for small scale production or through an in-line cavitron homogenizer for large scale production. Regardless of scale, homogenization is necessary to ensure a well-distributed flocculent addition resulting in small particle sizes, narrow distributions, and <1% coarse (>16 micron). This then translates to a final toner product complying with <1% coarse (>16 micron) specification. Typically, at the manufacturing scale, the homogenization step requires a minimum of 60 to 90 minutes which results in an overall 8 hours to produce EA toner. Other drawbacks with the current process include flocculent addition errors when dealing with pumping in the flocculent via a homogenizer. Often, the rate of pumping in flocculent is too rapid, or there are leakages. Also the current rotor-stator homogenizer generates about 10-15° C. heat. Thus, it is desirable to reduce the homogenization time (either by not producing the large agglomerates or finding a more effective flocculent distribution method) in order to reduce the overall toner cycle time and the amount of energy used. It is also desirable to reduce production costs for such toners and seek more environmentally friendly processes by reducing leakage of flocculent.

Improved methods for producing toners, which reduce the number of stages and materials, remain desirable. Acoustic mixing is a new approach to mixing and dispersion of materials ranging from nanoparticle suspensions to viscous gels. It is distinct from conventional impeller agitation found in a planetary mixer or speed mixer as well as ultrasonic mixing. Low frequency, high-intensity acoustic energy is used to create a uniform shear field throughout the entire mixing vessel. The result is rapid fluidization (like a fluidized bed) and dispersion of material. This invention proposes a new and effective flocculent distribution method and process for breaking toner particles with acoustic mixer using low-frequency, high intensity acoustic energy. By using an acoustic mixer, the toner slurry and flocculent can be mixed together and a good distribution of flocculent can be achieved in five (5) minutes, drastically reducing toner cycle time by about 17.8%. In addition, acoustic mixers come in a variety of sizes from a bench top model (roughly 500 milliliters) to manufacturing scale (30 gallons), which enables implantation of this process for both small and large scale purposes.

Another advantage of such process is that flocculent is now added directly to the slurry before acoustic mixing which reduces the need to pump in flocculent via a homogenizer. As such, there are no leaks as there is no need for material to flow through equipment. Further, the acoustic mixer does not generate any heat and thus, this process can be utilized for heat-sensitive materials.

SUMMARY

In embodiments, there is provided a method for making a toner particles comprising: a) mixing a composition comprising an amorphous resin emulsion, an optional crystalline resin emulsion, an optional wax emulsion, at least one colorant emulsion to form a composite emulsion; b) adding an aggregating agent to the composite emulsion to form pre-aggregated particles by subjecting the mixture to acoustic mixing with a g force of from about 50 g to about 100 g; c) aggregating the particles; and optionally, d) forming a shell on the particles to form an emulsion aggregated toner.

Another embodiment provides a method for making a toner particles comprising: a) mixing a composition comprising an amorphous resin emulsion, an optional crystalline resin emulsion, an optional wax emulsion, at least one colorant emulsion to form a composite emulsion; b) adding an aggregating agent to the composite emulsion to form pre-aggregated particles by subjecting the mixture to acoustic mixing with a g force of from about 90 g to about 100 g; c) aggregating the particles; and optionally, d) forming a shell on the particles to form an emulsion aggregated toner, wherein no heat is generated during the method for making toner particles.

In yet another embodiment, there is a method for making a toner particles comprising: a) mixing a composition comprising a linear amorphous resin emulsion, an optional crystalline polyester resin emulsion, an optional wax emulsion, at least one colorant emulsion to form an emulsion; b) adding an aggregating agent to the composite emulsion to form pre-aggregated particles by subjecting the mixture to acoustic mixing with a g of about 90 g; c) aggregating the particles; and optionally, d) forming a shell on the particles to form an emulsion aggregated toner.

In yet a further embodiment, there is provided a method for making a toner particles that reduces the overall toner cycle time by up to 20%.

BRIEF DESCRIPTION OF THE DRAWINGS

For a better understanding of the present embodiments, reference may be made to the accompanying figures.

DETAILED DESCRIPTION

Figure 1:
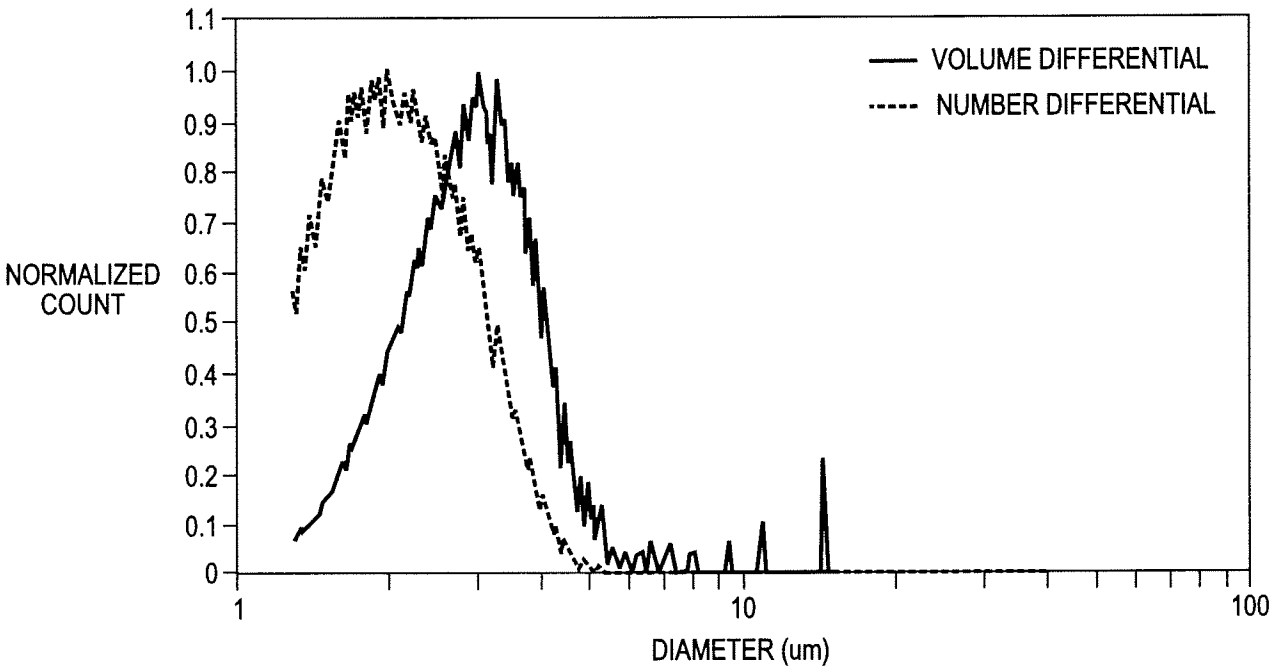
FIG. 1 is a graph showing particle size (number and volume) distribution of a toner produced in accordance with the present disclosure.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

Resins

Any toner resin may be utilized in the processes of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

In embodiments, the resin may be a polyester, polyimide, polyolefin, polyamide, polycarbonate, epoxy resin, and/or copolymers thereof. In embodiments, the resin may be an amorphous resin, a crystalline resin, and/or a mixture of crystalline and amorphous resins. The crystalline resin may be present in the mixture of crystalline and amorphous resins, for example, in an amount of from 0 to about 50 percent by weight of the total toner resin, in embodiments from 5 to about 35 percent by weight of the toner resin. The amorphous resin may be present in the mixture, for example, in an amount of from about 50 to about 100 percent by weight of the total toner resin, in embodiments from 95 to about 65 percent by weight of the toner resin.

In embodiments, the amorphous resin may be selected from the group consisting of polyester, a polyamide, a polyimide, a polystyrene-acrylate, a polystyrene-methacrylate, a polystyrene-butadiene, or a polyester-imide, and mixtures thereof. In embodiments, the crystalline resin may be selected from the group consisting of polyester, a polyamide, a polyimide, a polyethylene, a polypropylene, a polybutylene, a polyisobutyrate, an ethylene-propylene copolymer, or an ethylene-vinyl acetate copolymer, and mixtures thereof. In further embodiments, the resin may be a polyester crystalline and/or a polyester amorphous resin. In embodiments, the polymer utilized to form the resin may be a polyester resin, including the resins described in U.S. Pat. Nos. 6,593,049 and 6,756,176. Suitable resins may also include a mixture of an amorphous polyester resin and a crystalline polyester resin as described in U.S. Pat. No. 6,830,860.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate). The crystalline resin may be present, for example, in an amount of from about 5 to about 50 percent by weight of the toner components, in embodiments from about 10 to about 35 percent by weight of the toner components.

The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, polycondensation catalysts may be used in forming the polyesters. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfoisophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

The amorphous resin can possess various glass transition temperatures (Tg) of, for example, from about 40° C. to about 100° C., in embodiments from about 50° C. to about 70° C. The crystalline resin may have a number average molecular weight ($M_n$), for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography (GPC) using polystyrene standards. The molecular weight distribution ($M_w/M_n$) of the crystalline resin may be, for example, from about 2 to about 6, in embodiments from about 3 to about 4.

In embodiments, a suitable amorphous polyester resin may be a poly(propoxylated bisphenol A co-fumarate) resin having the following formula (1):

(1)

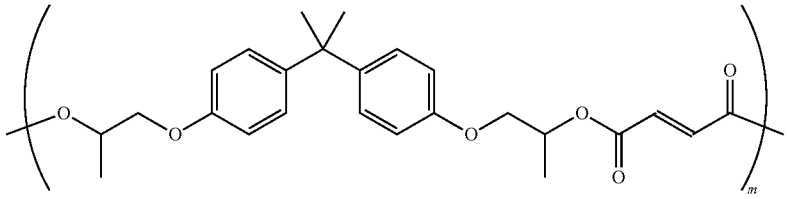

wherein m may be from about 5 to about 1000, in embodiments from about 10 to about 500, in other embodiments from about 15 to about 200. Examples of such resins and processes for their production include those disclosed in U.S. Pat. No. 6,063,827.

An example of a linear propoxylated bisphenol A fumarate resin which may be utilized as a toner resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins which may be utilized, optionally in combination with an amorphous resin as descried above, include those disclosed in U.S. Patent Application Publication No. 2006/0222991. In embodiments, a suitable crystalline resin may include a resin formed of ethylene glycol and a mixture of dodecanedioic acid and fumaric acid co-monomers with the following formula:

(II)

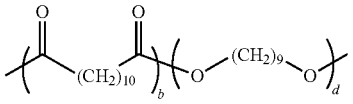

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a resin suitable for forming a toner.

Examples of other suitable toner resins or polymers which may be utilized include those based upon styrenes, acrylates, methacrylates, butadienes, isoprenes, acrylic acids, methacrylic acids, acrylonitriles, and combinations thereof. Exemplary additional resins or polymers include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

In embodiments, the resins may include polyester resins having a glass transition temperature of from about 30° C. to about 80° C., in embodiments from about 35° C. to about 70° C. In further embodiments, the resins utilized in the toner may have a melt viscosity of from about 10 to about 1,000,000 Pa*S at about 130° C., in embodiments from about 20 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, in embodiments from about 75 to about 85 percent by weight of the toner particles (that is, toner particles exclusive of external additives) on a solids basis. Where the resin is a combination of a crystalline resin and an amorphous resin, the ratio of crystalline resin to amorphous resin can be in embodiments from about 1:99 to about 30:70, in embodiments from about 5:95 to about 25:75, in some embodiments from about 5:95 to about 15:95.

Surfactants

In embodiments, resins, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX890™ and ANTAROX897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™ E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™ POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 837™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. In embodiments, emulsions of each of the components are prepared and then combined together in a composite emulsion. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5.

Following the preparation of the above mixture, an aggregating agent or flocculent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In embodiments, the aggregating agent is added to the slurry and then mixed in LabRAM ResonantAcoustic Mixers with a g force applied by the acoustic mixer to the mix load of from about 90 g to about 100 g (one g=9.81 m/$S^2$). Resonant acoustic mixing is distinct from conventional impeller agitation found in a planetary mixer or ultrasonic mixing. Low frequency, high-intensity acoustic energy is used to create a uniform shear field throughout the entire mixing vessel. The result is rapid fluidiziation (like a fluidized bed) and dispersion of material. Resonant acoustic mixing differs from ultrasonic mixing in that the frequency of acoustic energy is orders of magnitude lower. As a result, the scale of mixing is larger. Unlike impeller agitation, which mixes by inducing bulk flow, the acoustic mixing occurs on a microscale throughout the mixing volume.

In acoustic mixing, acoustic energy is delivered to the components to be mixed. An oscillating mechanical driver creates a motion in a mechanical system comprised of engineered plates, eccentric weights and springs. This energy is then acoustically transferred to the material to be mixed. The underlying technology principle is that the system operates at resonance. In this mode, there a nearly complete exchange of energy between the mass elements and the elements in the mechanical system. In a resonant acoustic mixing, the only element that absorbs energy (apart from some negligible friction losses) is the mix load itself. Thus, the resonant acoustic mixing provides a highly efficient way of transferring mechanical energy directly into the mixing materials. In the mixing of developer, the resonant frequency is the container and its contents, for example, the toner particles and the carrier particles.

In embodiments, the acoustic mixing occurs for a period of time of from about 5 minutes to about 10 minutes or for a period of time of from about 4 minutes to about 5 minutes. The mixing may be performed with various milling media, such as beads. The milling media may comprise a material selected from the group consisting of glass, steel, ceramic and mixtures of. The acoustic mixing, in embodiments, occurs at a temperature of from about 0° C. to about 50° C. or of from about 20° C. to about 30° C. The slurry may be mixed at a resonant frequency of from about 15 Hz to about 2000 Hz, or from about 20 Hz to about 1800 Hz, or from about 20 Hz to about 1700 Hz. The g force applied by the acoustic mixer to the mix load can be from about 50 g to about 100 g. In a specific embodiment, the slurry is mixed at a g force of about 90 g for about 5 minutes. In embodiments, the toner slurry has a solids content of from about 5 to about 30 percent solids by total weight of the toner slurry.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

In embodiments, the toner particles may have the following characteristics:

(1) Volume average diameter (also referred to as "volume average particle diameter") of from about 1.15 microns to about 1.25 microns.

(2) Number Average Geometric Size Distribution (GSDn) of from about 1 to about 25, and/or Volume Average Geometric Size Distribution (GSDv) of from about 1.10 to about 1.28.

The characteristics of the toner particles may be determined by any suitable technique and apparatus. Volume average particle diameter D50, GSDv and GSDn may be measured by means of a measuring instrument such as a Beckman Coulter, operated in accordance with the manufacturer's instructions. Once completed a sample, quenched in 4% NaOH and DIW is taken for particle size measurement on the coulter counter.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

The embodiments will be described in further detail with reference to the following examples and comparative examples. All the "parts" and "%" used herein mean parts by weight and % by weight unless otherwise specified.

Example 1

An emulsion aggregation toner was prepared as follows. Briefly, about 17.5 grams of a linear amorphous resin A in an emulsion (about 35 weight % resin) and 17.9 grams of a linear amorphous resin B in an emulsion (about 34 weight % resin) were added to a 200 milliliter plastic container (with lid). The linear amorphous resins A and B were of the following formula:

(I)

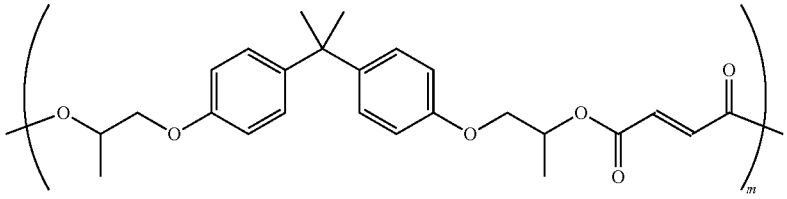

wherein m for linear amorphous resin A is from about 2 to about 10, and m for linear amorphous resin B is from about 2 to about 10; these resins were produced following the procedures described in U.S. Pat. No. 6,063,827. About 4.7 grams of a crystalline polyester resin composed of dodecanedioic acid and 1,9-Nonanediol with the following formula:

(II)

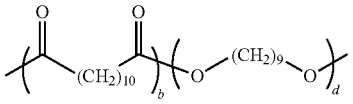

wherein b is from about 5 to about 2000 and d is from about 5 to about 2000, in an emulsion (about 10 weight % resin), synthesized following the procedures described in U.S. Patent Application Publication No. 2006/0222991, with about 8.5 grams of a cyan pigment, Pigment Blue 15:3 (about 1 wt %), about 0.59 grams of surfactant (Dowfax), about 7.4 grams of a polyethylene wax (about 1.5 wt %), and about 84 grams of deionized water, were added to the container. The pH of the mixture was adjusted to about 4.2 by adding nitric acid (about 0.3M). About 0.12 grams of $Al_2(SO_4)_3$ (about 27.8 weight %) was added as a flocculent to the slurry. About 83 grams of 3 millimeter stainless steel beads were added to the resulting slurry. The plastic container is then sealed with a lid and placed into an acoustic mixer (a LABRAM mixer from Resodyn Acoustic Mixers, Inc. (Butte, Mont.)) for 5 minutes and a resonant frequency of about 65 Hz. Once mixed, the particle characteristics were measured using the Coulter counter with the results shown in FIG. 1 (Coulter Trace of Toner Slurry after Resodyn mixer with 0% coarse). In this manner with a homogenizer, the flocculent addition occurs in-line drop wisely while homogenizing.

Figure 2:
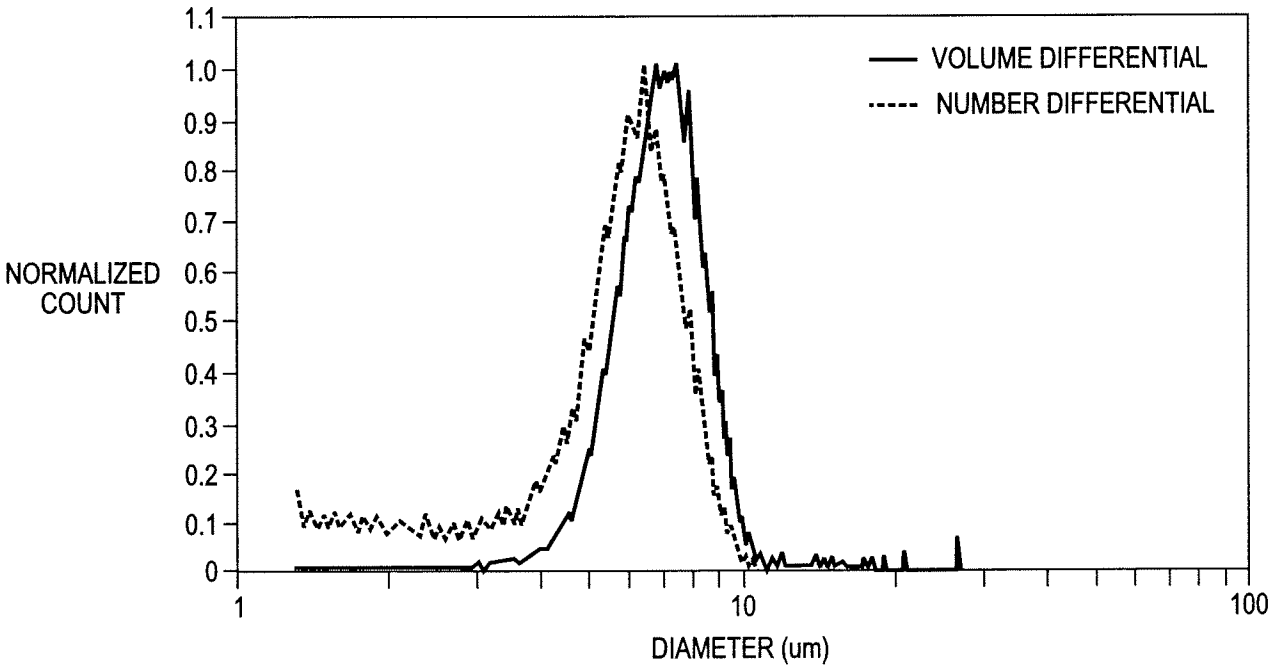
FIG. 2 is a graph showing particle size (number and volume) distribution of a toner produced in accordance with the present disclosure.

The slurry is then transferred to a 200 milliliter glass beaker with one P4 mixing blade on a hotplate. The final toner slurry has a % coarse of 0.39. The particle characteristics were once again measured using the Coulter counter with the results shown in FIG. 2 (Coulter Trace of final EA toner with 0.39% coarse).

Thereafter, the toner particles are aggregated and may optionally have a shell formed over the particles.

Example 2

Figure 3:
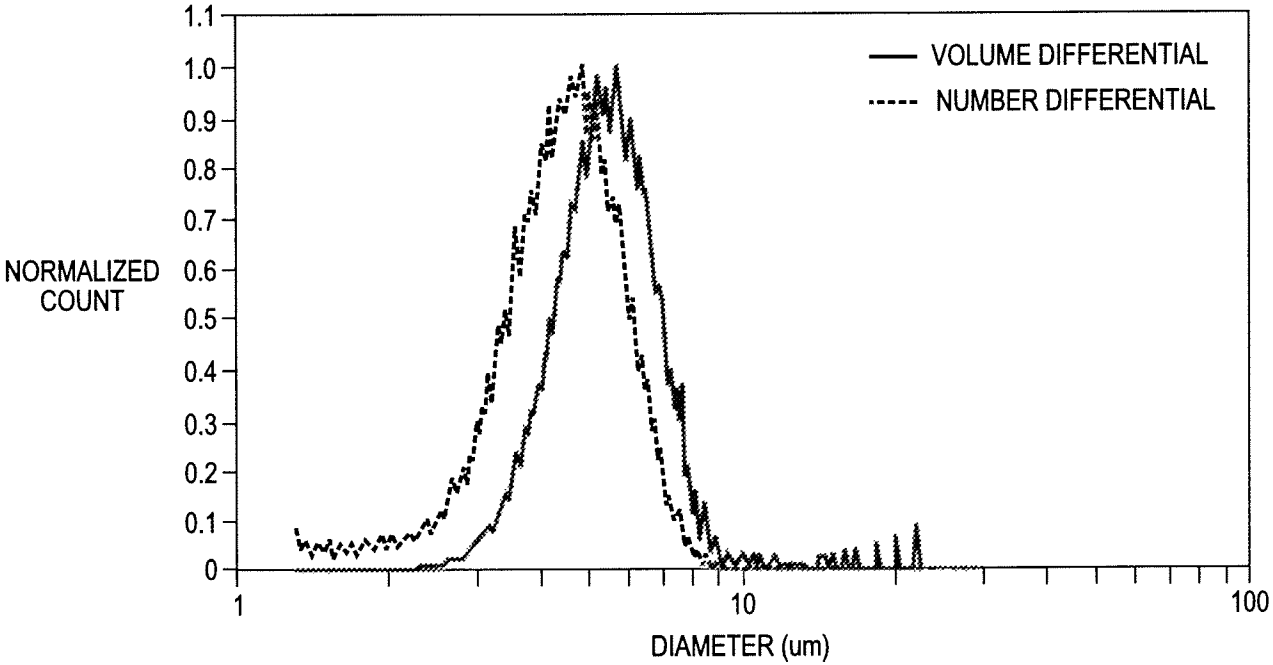
FIG. 3 is a graph showing particle size (number and volume) distribution of a toner produced in accordance with the present disclosure.
Figure 4:
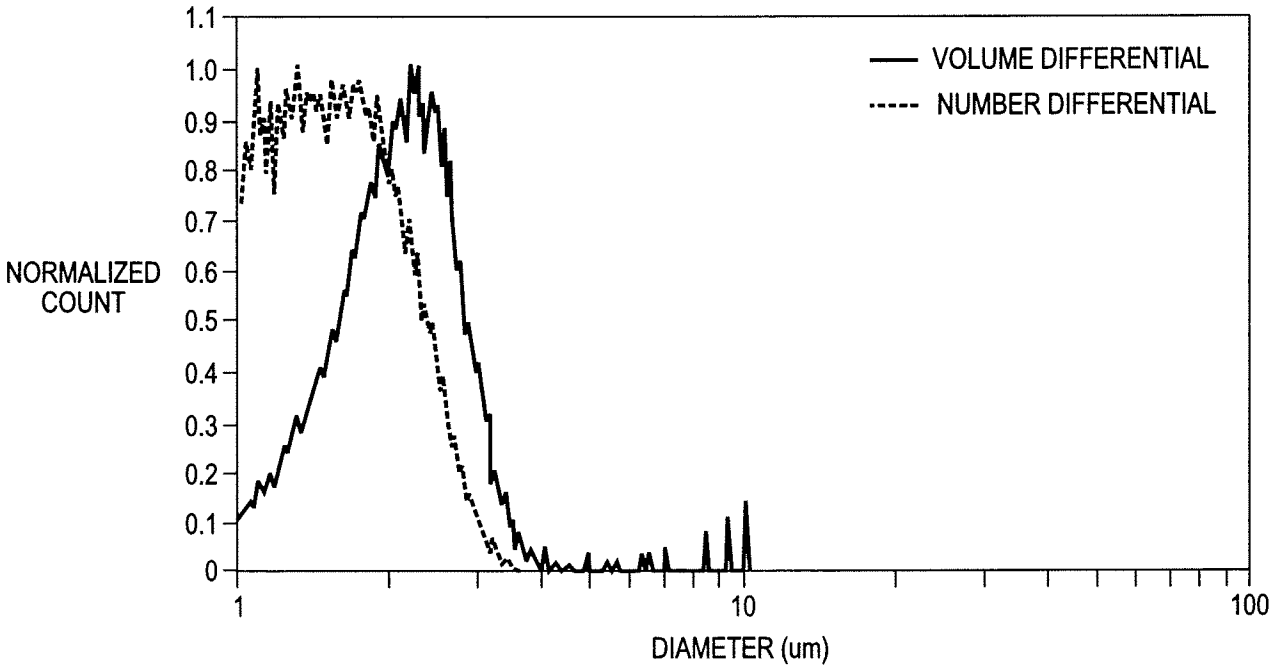
FIG. 4 is a graph showing particle size (number and volume) distribution of a toner produced in accordance with the present disclosure.

An EA toner was prepared by following the same procedures and material compositions as those described in Example 1 above, but with the exception that no stainless steel beads were used. Once mixed, the particle characteristics for the toner slurry after acoustic mixing and the final toner were measured using the Coulter counter with the results shown in FIG. 3 (Coulter Trace of Toner Slurry after Resodyn mixer with 0.49% coarse) and FIG. 4 (Coulter Trace of final EA Pinot toner with 0.47% coarse.).

Comparative Example 1

Figure 5:
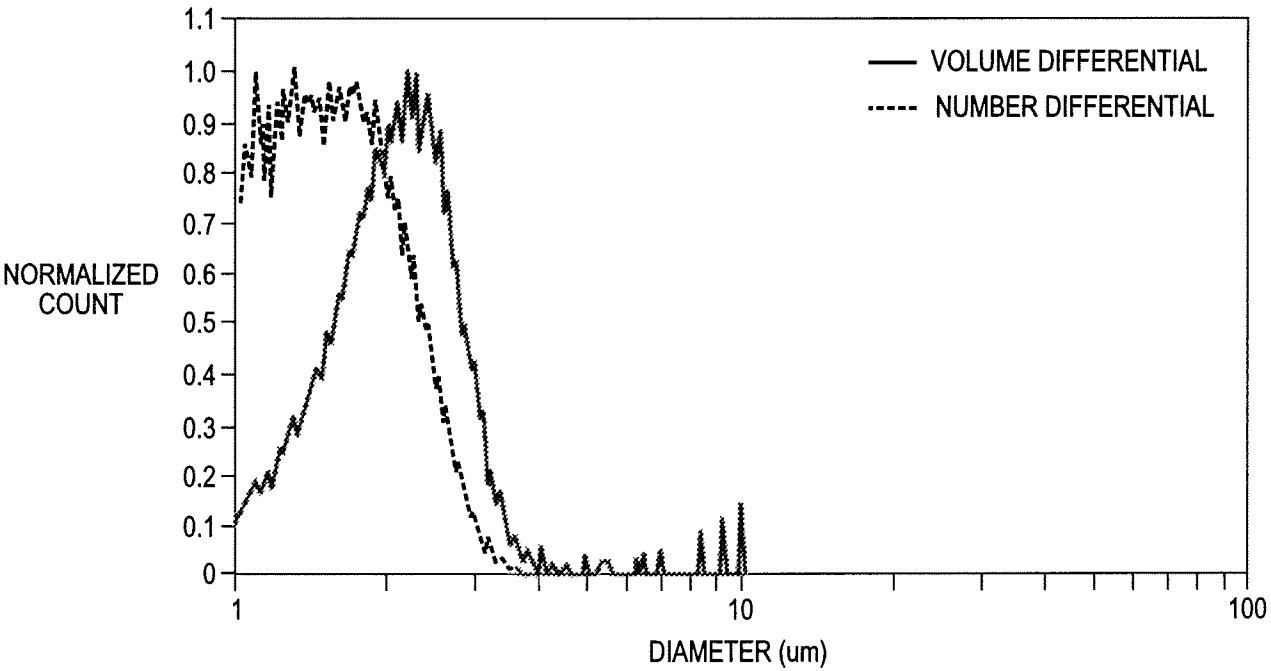
FIG. 5 is a graph showing particle size (number and volume) distribution of a comparative toner produced in accordance with previous processes.
Figure 6:
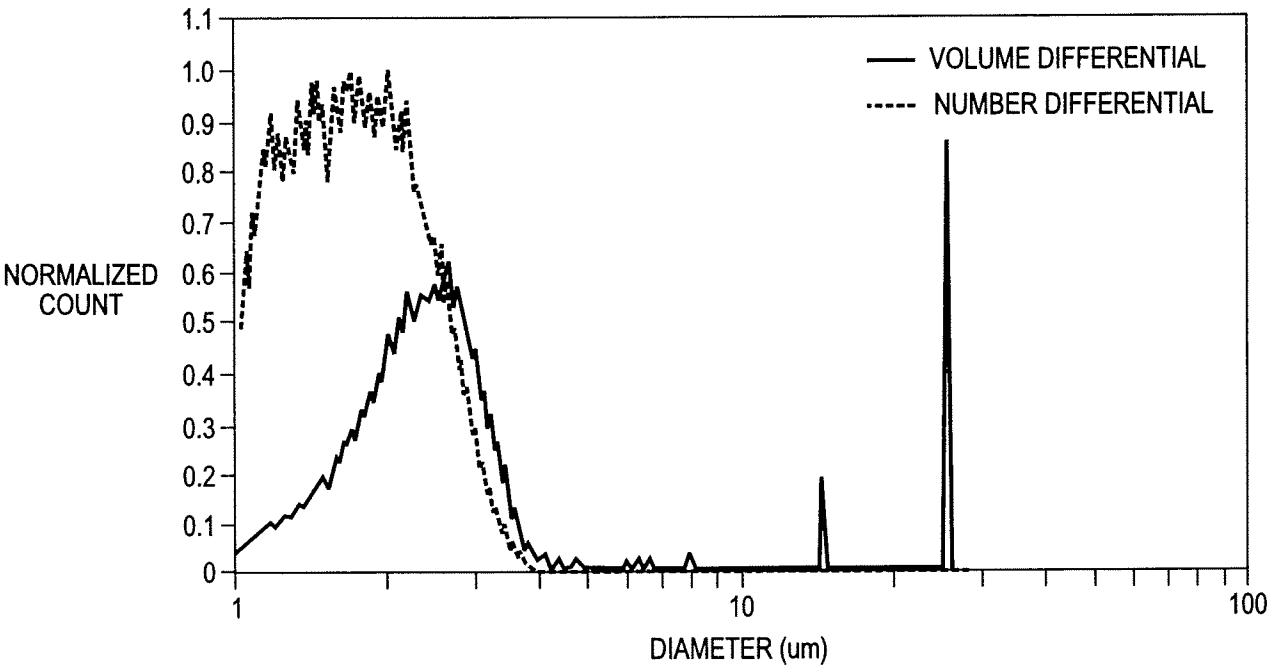
FIG. 6 is a graph showing particle size (number and volume) distribution of a comparative toner produced in accordance with previous processes.

Briefly, in a 2 liter plastic beaker, the two amorphous resins (about 147 grams of linear amorphous resin A in an emulsion (about 35.2 weight % resin) and about 154 grams of linear amorphous resin B in an emulsion (about 33 weight % resin) were added with 45 grams of a crystalline polyester resin emulsion, 4.89 grams of surfactant (Dowfax), 62 grams of wax (IGI), 71 grams of a cyan pigment, Pigment Blue 15:3 (about 15.6 wt %), and about 589 grams of deionized water. The pH of the mixture was adjusted to about 4.2 by adding about 5 gram of nitric acid (about 0.3M). The slurry is then homogenized for a total of 5 minutes at 3000-4000 rpm while adding in the flocculent, about 49.8 grams of $Al_2(SO_4)_3$ (about 10 weight %). Once completed, a sample, quenched in 4% NaOH and deionized water, is drawn for particle size measurement on the Coulter Counter, with the results shown in FIG. 5 (Coulter trace after flocculent addition using IKA Homogenizer with 0% coarse) and FIG. 6 (Coulter trace after flocculent addition using IKA Homogenizer with 2.83% coarse).

Toners from this Comparative Example 1 were compared with the toners produced in Examples 1 and 2. Particle size, volume average geometric size distribution ($GSD_v$), number average geometric size distribution ($GSD_n$), and % coarseness are set forth below in Table 1.

TABLE 1

| | $D_{50}$ (microns) | $GSD_v$ | $GSD_n$ | % coarse |
|---|---|---|---|---|
| Example 1 (K694C with Stainless Steel Beads) | 2.86 | 1.3552 | 1.369 | 0 |
| Example 2 (K689C without Stainless Steel Beads) | 2.78 | 1.3265 | 1.3405 | 0.49 |
| Comparative Example 1 (KNPE529C using IKA Homogenizer) | 1.3268 | 1.3268 | 1.3564 | 0 |

As shown in Table 1 above, the EA toner particles prepared by the process of the present disclosure (Examples 1 and 2) had similar properties compared with the toner of Comparative Example 1, with overall reduced toner cycle time of 17.8%. The resulting toner particles also show comparable GSD values, demonstrating that the process utilized to prepare the toner of the present disclosure had minimal impact on the final toner properties.

The present embodiments provide a method for making toner particles which provides a number of benefits over prior methods, including the ability to mix in flocculent (with or without beads) into an EA toner slurry without the use of a homogenizer, preventing pre-mature toner growth useful for heat sensitive materials (no heat generated by the mixing), a "one-pot" system with very low chance for equipment failure due to leaks or improper pumping, and a reduction of overall toner cycle time by up to 20%.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for making a toner particles comprising:

a) mixing a composition comprising an amorphous resin emulsion, an optional crystalline resin emulsion, an optional wax emulsion, at least one colorant emulsion to form a composite emulsion;

b) adding an aggregating agent that has not been homogenized to the composite emulsion;

c) subjecting the composite emulsion and aggregating agent to acoustic mixing at a g force of from about 50 g force to about 100 g force to form a toner slurry of preaggregated particles;

d) aggregating the particles; and optionally, e) forming a shell on the particles to form an emulsion aggregated toner.

2. The process of claim 1, wherein step (b) is performed at a resonant frequency of from about 15 Hz to about 2000 Hz.

3. The process of claim 1, wherein step (b) is performed with or without milling media.

4. The process of claim 3, wherein the milling media comprises a size of from about 0.5 mm to 10 mm.

5. The process of claim 3, wherein the milling media comprises a material selected from the group consisting of glass, steel, ceramic and mixtures thereof.

6. The process of claim 1, wherein acoustic mixing occurs for a period of time of from about 5 minutes to about 10 minutes.

7. The process of claim 1, wherein acoustic mixing occurs at a temperature of from about 0° C. to about 50° C.

8. The process of claim 1, wherein the toner slurry has a solids content of from about 5 to about 30 percent solids by total weight of the toner slurry.

9. The process of claim 8, wherein the toner slurry has a solids content of from about 10 to about 20 percent solids by total weight of the toner slurry.

10. The process of claim 1, wherein the amorphous resin is selected from the group consisting of polyester, a polyamide, a polyimide, a polystyrene-acrylate, a polystyrene-methacrylate, a polystyrene-butadiene, or a polyester-imide, and mixtures thereof.

11. The process of claim 1, wherein the optional crystalline resin is selected from the group consisting of polyester, a polyamide, a polyimide, a polyethylene, a polypropylene, a polybutylene, a polyisobutyrate, an ethylene-propylene copolymer, or an ethylene-vinyl acetate copolymer, and mixtures thereof.

12. The process of claim 1, wherein the mixture further comprises a component selected from the group consisting of surfactants, functional monomers, initiators, surface additives, charge control agents, chain transfer agents, and combinations thereof.

13. The process of claim 1, wherein the aggregating agent is selected from the group consisting of polyaluminum chloride, polyaluminum sulfo silicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, and combinations thereof.

14. The process of claim 1, wherein the colorant is selected from the group consisting of carbon black, cyan, yellow, magenta, red, orange, brown, green, blue, violet, and combinations thereof.

15. A method for making toner particles comprising:

a) mixing a composition comprising an amorphous resin emulsion, an optional crystalline resin emulsion, an optional wax emulsion, at least one colorant emulsion to form a composite emulsion;

b) adding an aggregating agent that has not been homogenized to the composite emulsion;

c) subjecting the composite emulsion and aggregating agent to acoustic mixing at a g force of from about 50 g force to about 100 g force to form a toner slurry of preaggregated particles;

d) aggregating the particles; and optionally, e) d) forming a shell on the particles to form an emulsion aggregated toner, wherein no heat is generated during the method for making toner particles.

16. The process of claim 15, wherein the amorphous resin is linear in structure and the optional crystalline resin is a polyester, the linear amorphous resin having the following formula:

(I)

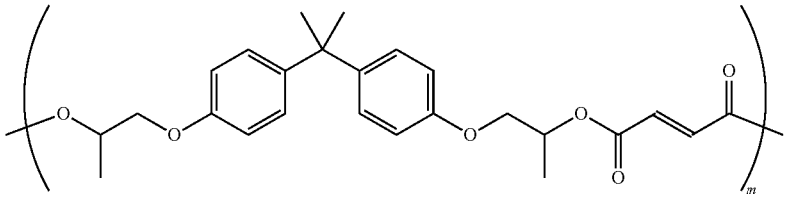

wherein m for linear amorphous resin A is about from about 2 to about 10, and m for linear amorphous resin B is about from about 2 to about 10.

17. The process of claim 15, wherein the crystalline polyester resin has the following (II)

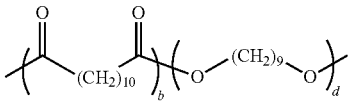

wherein b is from about 5 to about 2000 and d is from about 5 to about 2000.

18. A method for making a toner particles comprising:

a) mixing a composition comprising a linear amorphous resin emulsion, an optional crystalline polyester resin emulsion, an optional wax emulsion, at least one colorant emulsion to form a composite emulsion;

b) adding an aggregating agent that has not been homogenized to the composite emulsion;

c) by subjecting the composite emulsion and aggregating agent to acoustic mixing at a g force of about 90 g force to form a toner slurry of preaggregated particles;

d) aggregating the particles; and optionally, d) forming a shell on the particles to form an emulsion aggregated toner.

19. The process of claim 18, wherein the linear amorphous resin has the following formula:

(I)

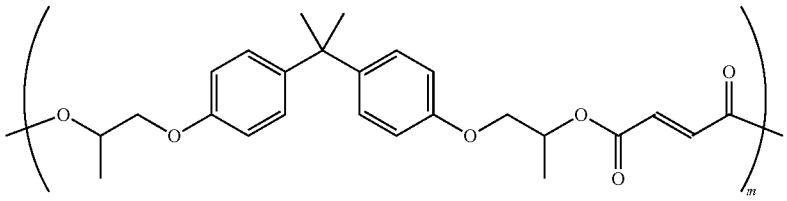

wherein m for linear amorphous resin A was about is about from about 2 to about 10, and m for linear amorphous resin B was about is about from about 2 to about 10.

20. The process of claim 18, wherein the crystalline polyester resin has the following (II)

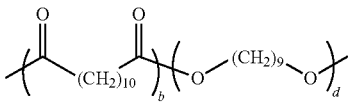

wherein b is from about 5 to about 2000 and d was from about 5 to about 2000.

* * * * *